United States Patent [19]

Söredal

[11] Patent Number: 4,933,108

[45] Date of Patent: Jun. 12, 1990

[54] EMITTER FOR FIELD EMISSION AND METHOD OF MAKING SAME

[76] Inventor: Sven G. Söredal, Birger Jarlsgatan 42, 114 29 Stockholm, Sweden

[21] Appl. No.: 29,381

[22] Filed: Apr. 12, 1979

[30] Foreign Application Priority Data

Apr. 13, 1978 [SE] Sweden ..... 78041639

[51] Int. Cl.[5] ..... H01B 1/06

[52] U.S. Cl. ..... 252/518; 252/512; 252/520

[58] Field of Search ..... 252/512, 518; 313/336; 75/232, 245, 248

[56] References Cited

U.S. PATENT DOCUMENTS 3,842,309 10/1974 Van Stratum et al. ..... 29/25.17

4,147,954 3/1979 Tuck ..... 313/346 R

*Primary Examiner*—Josephine Barr

*Attorney, Agent, or Firm*—Davis Hoxie Faithfull & Hapgood

[57] ABSTRACT

A field emitter consists of a metal carrier wire coated with crystals of an oxide having a metallic luster and which is a compound of a transition metal selected from the group consisting of tungsten, molybdenum, niobium, vanadium and titanium.

4 Claims, No Drawings

EMITTER FOR FIELD EMISSION AND METHOD OF MAKING SAME

This invention concerns an emitter for field emission comprising a carrier usually in the form of a wire or an edge of metal provided with crystals with sharp corners or points. The emitter is mainly characterized by the fact that the crystals consist of a tungsten bronze or an analogous compound of another transition metal, in particular of molybdenum, niobium, vanadium or titanium. The invention further comprises the method of producing such emitter.

By field emission, either electrons or positive or negative ions can be emitted by means of a very strong electric field. Ion emission can be field ionization (FI) or field desorption (FD). At FI the ions are formed of molecules in the surrounding gas by losing or capturing one or sometimes more electrons, whereas ions are formed of molecules of substances covering the emitter at FD. The advantage of this type of ionization is that it is mild, i.e. very few molecules are fragmented, so it gives mainly molecular ions. At the emission of electrons the advantage is that the power and thus the heat dissipation to the surroundings is much less than at thermal emission.

The field needed is very strong, at least 1 V/Å. This applies to the emission of both electrons and ions. Hence field concentration by means of sharp points or corners is required in order to avoid the use of an extremely high tension.

Till now the most common way of obtaining sufficiently sharp points has been subjecting a carrier in the form of a very thin wire (usually 2.5–10 μm diameter), a sharp edge or another device comprising parts with very small radius of curvature, to an organic vapor, often acetone or better benzonitrile, at a low pressure and suitable temperature and in an electric field for some hours. Then small whiskers of a product of polymerization with high carbon content are formed. The carrier is then usually heated to a rather high temperature, 800°–900° C., at which treatment the whiskers probably are graphitized. (See e.g. H. D. Beckey et al: Messtechnik 9/71 p. 196).

Some authors have tried to deposit metals (nickel or cobalt) electrolytically under such circumstances that free crystal corners or dendrites are formed. (See e.g. M. M. Bursey et al: J. of Physics E 1976, Vol 9, p. 145). Other materials have also been proposed e.g. lanthanum hexaboride, crystallized onto a carrier from a melt (H. Ahmed et al: J. of Physics E 1976, Vol. 9 p. 4).

Carbon-containing whiskers give rather great energy spread in the electron or ion beam, probably because of the electrical resistance of the whiskers. Another drawback is that the emission drops after some time, and consequently the emitter must be reactivated now and then. Another drawback is the need of using extremely thin wires which are difficult to handle. The other materials mentioned above have given less emission current than those activated in an organic vapor. An example of the emission from emitters activated in an organic vapor are the following values mentioned in M. D. Migahed and H. D. Beckey: J. of Mass Spectrometry and Ion Physics 7 (1971) p. 1.

A platinum wire with the diameter 2.5 μm gave in acetone vapor with 2.3 mtorr the following currents. The arrangement (distance to the counter electrode and so on) is not described.

| | | | |
|---|---|---|---|
| kV | 6 | 7 | 8 |
| nA | 1 | 8 | 3 |

Much better results than those of earlier known emitters have been achieved with emitters according to this invention which emitters comprise a carrier e.g. of a transition metal provided with crystals with sharp corners or points, the crystals consisting of a tungstate bronze or an analogous compound of an other transition metal, in particular of molybdenum, niobium, vanadinum or titanium. A much thicker carrier can then be used.

If a wire or an edge of tungsten is dipped into a melt containing tungsten trioxide and lithium oxide, which melt also can be described as a mixture of tungsten trioxide and lithium tungstate (if the tungsten trioxide is in excess which usually is the case) the non-stoichiometric compound lithium tungstate bronze is formed by reduction according to the formula $$3xLi_2WO_4+(6-4x)WO_3+xW=6Li_xWO_3$$

In this formula x alwys is less than 1. In some (the fraction x) of the elementary cells there is a lithium ion, and in these cells the tungsten atom has the valency 5+ instead of 6+. The lithium tungstate bronze forms crystals on the carrier giving an unexpectedly great field concentration and correspondingly strong emission current. Similar compounds are formed with inter alia molybdenum, niobium, vanadium, and titanium instead of tungsten, besides which lithium can be replaced by a great number of metals, e.g. other alkali metals, alkaline earth metals, rare earth metals and so on. I prefer lithium tungstate bronze partly because it is formed with a suitable speed, partly because the melt covering the emitter after the dipping is easily dissolved, as lithium tungstate is the most soluble of the tungstates.

These compounds, known per se, have several remarkable properties. In spite of the fact that they are oxides they have metallic type of electric conductivity or are in some cases semiconductors. Those with metallic type of conductivity have about the same conductivity as metals, thus several powwers of ten higher than that of graphite. (They also have metallic lustre, that is why they are called bronzes). They have great tendency to form perfect crystals with sharp corners and edges. They are further both chemically and thermally very stable, can be boiled in such corrosive acids as nitric acid and hydrofluoric acid and mixtures of them as well as in alkali metal hydroxide solutions. Most of them can withstand heating to at least 1200° C.

Instead of just dipping the carrier in the melt, it is possible to make use of cathodic reduction applying current from an outer source, the anode being made of carbon or platinum. In reality even the chemical reduction probably is electrolytic caused by local cells, otherwise the crystals should loosen, so the formula given above can be regarded as the sum of the anodic and cathodic processes.

As an example of the performance of the invention a tungsten wire 0.1 mm in diameter is fixed in a holder, cut to suitable length and straightened. It is rinsed in e.g. acetone, ethanol or propanol and etched anodically in e.g. 10% potassium hydroxide solution with 20 mA per cm length during 20 s. The purpose of the etching is to get the result independent of the state of the wire surface. After rinsing in water it is dipped for 1 minute in a melt made of tungsten trioxide and 0.255 g of lithium carbonate per gram tungsten trioxide at 780° C. This melt contains 80 mole-% lithium tungstate and 20 mole-% tungsten trioxide (or said in another way about 56 mole-% tungsten trioxide and 44 mole-% lithium oxide) constituting an eutectic mixture melting at 696° C. It is not convenient to make the melt of lithium oxide and tungsten trioxide because both have very high melting points, so the process would be very slow. If lithium hydroxide or carbonate is used, it melts and the tungsten trioxide is dissolved and expels water or carbon dioxide. The hydroxide may loose water, if the speed of heating is unsuitable so it is better to use the carbonate. When the wire is withdrawn from the melt, it is put into a weak alkaline solution, containing e.g. 0.5% lithium carbonate and 0.5% sal ammoniac. After 2–3 hours the melt is dissolved and the emitter is ready. It is advisable to measure the emission from different parts of the emitter, so the best part can be used.

Emitters of average grade made in this way of 0.10 and 0.15 mm tungsten wire gave the following emission current when mounted concentric with a cylinder with the inner diameter 6 mm and the length 10 mm in acetone vapor at 3 mtorr pressure. Good emitters could give 2–3 times higher emission current.

| kV | 1,5 | 2 | 3 | 4 | 5 | 6 | 7 | 8 |
|---|---|---|---|---|---|---|---|---|
| nA, 0,10 mm | 0,5 | 4 | 55 | 200 | 510 | 1200 | | |
| nA, 0,15 mm | | | 0,26 | 1,5 | 4,3 | 10 | 21 | 38 |

It can be seen from these figures that the emission current is much stronger than the thinner wire, 100–200 times stronger at the same tension. The ratio between the diameters is only 1.5. The figures given earlier are valid for emitters with 40 times less diameter than the thinner of these emitters and gave less emission. The difference is much bigger than that which can depend on different test arrangements.

In the foregoing, reference is made to the carrier as being in the form of a very thin wire, a sharp edge or other device comprising parts with a very small radius of curvature. Accordingly, it is to be understood that the term "wire" as used in the accompanying claims is intended to have a connotation broad enough to cover these various forms.

As noted above, the carrier is made of a transition metal in elemental form, whereas the crystals are of a compound. The transition metal for the carrier may be the same transition metal which the crystals contain.

I claim:

1. An emitter for field emission consisting essentially of a metal carrier wire coated with crystals of an oxide compound which has a metallic luster and which is a compound of a transition metal selected from the group consisting of tungsten, molybdenum, niobium, vanadium and titanium.

2. The emitter of claim 1, in which the carrier wire is made of the same transition metal as contained in said crystals.

3. The emitter of claim 1, in which said crystals consist of lithium tungstate bronze.

4. The emitter of claim 3, in which the carrier wire is made of tungsten.

* * * * *

UNITED STATES PATENT AND TRADEMARK OFFICE

CERTIFICATE OF CORRECTION

PATENT NO. : 4,933,108

DATED : June 12, 1990

INVENTOR(S) : Sven Gunnar Soredal

It is certified that error appears in the above-identified patent and that said Letters Patent is hereby corrected as shown below:

Col. 2, line 3, "3" should be --30--;

Col. 2, line 8, after "invention" insert a --,--.

Signed and Sealed this

Eighth Day of October, 1991

*Attest:*

HARRY F. MANBECK, JR.

*Attesting Officer*

*Commissioner of Patents and Trademarks*